US006658122B1

(12) United States Patent
Westermann et al.

(10) Patent No.: US 6,658,122 B1
(45) Date of Patent: Dec. 2, 2003

(54) METHOD FOR IN-SITU MEASURING AND IN-SITU CORRECTING OR ADJUSTING A SIGNAL PROCESS IN A HEARING AID WITH A REFERENCE SIGNAL PROCESSOR

(75) Inventors: Soren Erik Westermann, Fredensborg (DK); Morten Kroman, Taastrup (DK)

(73) Assignee: Widex A/S, Vaerloese (DK)

( * ) Notice: Subject to any disclaimer, the term of this patent is extended or adjusted under 35 U.S.C. 154(b) by 0 days.

(21) Appl. No.: 09/830,932

(22) PCT Filed: Nov. 9, 1998

(86) PCT No.: PCT/EP98/07132

§ 371 (c)(1),
(2), (4) Date: Aug. 6, 2001

(87) PCT Pub. No.: WO00/28784

PCT Pub. Date: May 18, 2000

(51) Int. Cl.[7] ..... H04R 25/00
(52) U.S. Cl. ..... 381/312; 381/312
(58) Field of Search ..... 381/312, 316, 381/317, 318, 320, 66, 56, 58, 60, 104, 107, 108

(56) References Cited

U.S. PATENT DOCUMENTS 4,596,902 A 6/1986 Gilman

FOREIGN PATENT DOCUMENTS

CH 678692 A5 10/1991
DE 41 28 172 A1 3/1993

*Primary Examiner*—Sinh Tran
(74) *Attorney, Agent, or Firm*—Sughrue Mion, PLLC

(57) ABSTRACT

The application relates to an in-situ method to measure and adjust the sound signal presented to the eardrum by means of a hearing aid and a hearing aid employing such a method. The hearing aid comprises microphone (1), signal processing system comprising digital signal processor (2) for transforming the microphone signal into a transformed signal according to a desired transformation function, sensor (4) sensing the sound signal appearing in front of the eardrum and comparator (5). Reference signal processor (6) generates a reference signal based on the output of microphone (1) and representative of the desired sound signal in front of the eardrum. A transfer function between receiver (3) and the output of sensor (4) is established to correct the process in reference signal processor (6). The sound signal in front of the eardrum is sensed, fed back and compared in said comparator (5) with said reference signal. In the case that the difference between the sensed signal and the reference signal is above a predetermined threshold the transformed signal is corrected to adjust said signal in front of the eardrum to the desired sound signal.

19 Claims, 6 Drawing Sheets

D y6
Comparison
NO
YES
Establishing Addresses for Look-up Table
y7
Reading Address Values
y8
Correcting the Acoustical Signal
y9
Correcting the Reference Signal
y10
Generating Error Signal
y11
E

METHOD FOR IN-SITU MEASURING AND IN-SITU CORRECTING OR ADJUSTING A SIGNAL PROCESS IN A HEARING AID WITH A REFERENCE SIGNAL PROCESSOR

BACKGROUND OF THE INVENTION

The invention relates to a method or process for improving the sound signal as presented to the eardrum or tympanic membrane of a user.

Measurements and corrections of this kind are, at least in parts, known from the prior art.

Thus, German Publication DE 28 08 516 A1 discloses a hearing aid using, in addition to the receiver, a measurement microphone, preferably as a unitary device, to develop in the earcanal in front of the eardrum a corresponding signal which may be used for the compensation of linear and/or nonlinear distortions. The instantaneous values of the signal from the probe microphone are compared with the undistorted output signal of the preamplifier in a differential amplifier resulting in a correction voltage which is added to the input signal of the output amplifier, resulting in a corrected output signal from the receiver.

In the U.S. Pat. No. 4,596,902 a processor controlled hearing aid is disclosed using a feedback microphone located in the earcanal to develop a control signal representative of the spectrum of the actual sound pressure levels by frequency in front of the eardrum. A processor compares averages of the actual sound pressure levels in front of the eardrum with the desired levels for the overall output in accordance with a predetermined set of reference instructions stored in a memory, and thus, controls the channel amplifiers and an output amplifier to produce the desired sound pressure levels in the earcanal in front of the eardrum.

In DE 41 28 172, a hearing aid is disclosed with an input transducer, an output transducer and a microprocessor connected between the input and the output transducers for digital signal processing of the input transducer signal. The processor transferfunction of the digital signal processing is stored in an EEPROM. The hearing aid further comprises testing means for sensing the actual sound pressure levels in the earcanal. The hearing aid operates in two differently distinct modes, namely a hearing aid mode and a measuring mode. The actual operating mode may be selected by the user. In the measuring mode the microprocessor generates a sequence of different tones of stepwise ascending volumes, and the sensing means senses the resulting sound pressure levels in the earcanal. The measured levels are compared with predetermined stored levels and corrections to the stored parameters of the transmission characteristic representative of said levels are performed in response to the determined differences. Thus, corrections can not be performed in real time.

CH 678 692 A discloses a method and an apparatus for determining individual acoustical properties of a human ear wearing a hearing aid. The apparatus consists of an in-the-ear hearing aid with a microphone, an amplifier and a loudspeaker. The hearing aid further comprises a sensing microphone for sensing sound emitted by the loudspeaker for determination of the acoustical properties in-situ. In one embodiment, the loudspeaker is alternatingly operating as a loudspeaker and a microphone.

Thus, it is an object of the present invention to create or develop a new method or process of the kind referred to above by which such measurements and corrections could be executed almost in real time, and to use such a method to generate an error signal and use such an error signal for correcting or adjusting the sound signal as presented in front of the eardrum in real time, to facilitate adjustment of the sound signals in the earcanal dynamically to instantaneous variations in the conditions prevailing between the sound outlet in the earcanal and the eardrum.

SUMMARY OF THE INVENTION

This new method to measure and correct or adjust the sound signal presented to the eardrum by means of a hearing aid in the operational position, including at least one microphone, at least one digital processing system comprising at least one digital signal processor for transforming the incoming sound signal into a transformed signal in conformity with a desired transformation function, at least one receiver and a power supply, and having at least one sensing means for sensing the signal appearing in front of the eardrum, said method using a reference signal representative of a desired sound signal in front of the eardrum, is characterized by generating a reference signal in a reference signal processor, said reference signal being based on an output signal of at least one microphone and being representative of a desired signal in front of the eardrum, establishing a transfer function between the receiver and the output of the sensing means, correcting the process in said reference signal processor in conformity with said transfer function, sensing the sound signal in front of the eardrum and feeding said sensed signal back to an input of the signal processing system, comparing said sensed signal in a comparison means with the corrected reference signal and, in case there is a material difference between the sensed signal and the corrected reference signal, correcting said transformed signal into a corrected transformed signal for adjusting the signal in front of the eardrum to the desired sound signal.

It is particularly advantageous, if the entire operation is performed digitally, which would lead to large scale integration of most or almost all components of the system.

Further advantages of the invention will become apparent from the remaining claims and the description.

BRIEF DESCRIPTION OF THE DRAWINGS

The invention will now be described in detail with respect to several embodiments shown in the attached drawings.

In the drawings

DETAILED DESCRIPTION OF THE INVENTION

Figure 1:
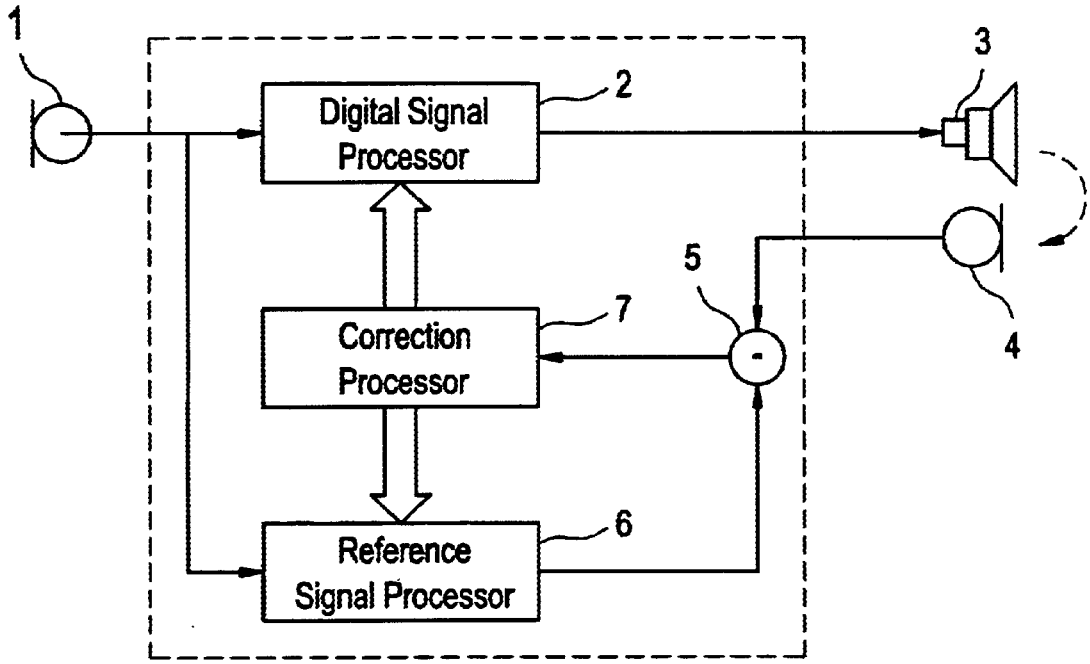
FIG. 1 shows schematically a first embodiment of a hearing aid to be used for practising the inventive method.

In the hearing aid as shown schematically in FIG. 1, the acoustical sound pressure prevailing in the environment surrounding the user is picked up by an input tranducer of the hearing aid, in this case a micronphone 1. The output signal of microphone 1 is applied to a processing system, preferably a digital signal processing system operating in accordance with the present invention and containing at least one digital signal processor 2, which processes the incoming signal in accordance with the hearing deficiency of the user and to the prevailing acoustical environmental situation. The output of the digital processor 2 is passed on to an output transducer, in this case a receiver 3.

The sound pressure levels in the earcanal are sensed by at least one sensing means, in this case by a probe microphone 4 that can be separate from the receiver, or incorporated into the receiver.

Equally, the receiver could be used also as a probe transducer or as such in combination with a probe microphone.

Principally, while the drawings show a hearing aid for performing the inventive method as a single channel hearing aid, it is to be understood that, obviously, the invention is by no means limited to single channel hearing aids but is, preferably so, also applicable to multi-channel hearing aids.

Also it is to be understood that in place of one input transducer or microphone several microphones could be provided as well as any other conceivable type of input transducer producing an input signal. The output transducer could as well be any type of output transducer that produces an output signal, i.e. a sound signal in front of the eardrum.

Furthermore, analog to digital and digital to analog converters would have to be employed, where required, preferably in the form of sigma-delta-converters.

The sensing means, i.e. the probe microphone 4 is directly or indirectly connected to a comparison means 5, the purpose of which will be explained below. Also there is shown a reference signal processor 6, which in this case receives an input signal from the input side of the digital signal processor 2 or even from the output of the microphone 1 to generate a reference signal which originally will be representative of a desired sound signal or sound pressure level in front of the eardrum.

This reference signal processor will process the incoming signal into a desired reference signal in conformity with the signal that is to be expected at the output of the sensing means, i.e. the probe microphone 4. Thus, the reference signal processor 6 will operate in a manner similar to the operation of the digital signal processor 2 in conjunction with the output transducer and the sensing means. This process is adjustable by the operation of the entire circuit.

Finally, preferably in combination with the reference signal processor 6 a correction processor means is provided which is equally connected to the comparison means.

The correction process of 7 operates with a transfer function comprising the signal path from the input of the output transducer to the output of the sensing means. Such a transfer function could be established in a well known manner. The transfer function on which the correction processor 7 operates can partly or totally consist of the function in reference signal processor 6.

In operation, the sensing means, i.e. the probe microphone senses the signal or the sound pressure level in front of the ear drum. The output signal of the probe microphone is then, either directly or indirectly applied to the comparison means 5 which also receives the reference signal from the reference signal processor 6 as a second input signal. If, at the comparison means 5, a material difference is detected between the two signals, an error signal is developed. This error signal is applied to the correction processor 7 where it is analized in conjunction with the transfer function. In accordance with this analysis of the error signal the correction processor 7 may then change the parameter set controlling the transfer characteristic of the digital signal processor 2 and/or the reference signal processor 6 to adapt or change the reference signal as well. For the is purpose the correction processor 7 is also connected to the digital signal processor 2 and to the reference signal processor 6.

In this analysis the correction processor 7 determines whether the error signal is inside an acceptable range of values or not. If the error signal is outside an acceptable range of values the correction processor operates on the digital signal processor 2 to change its set of parameters and, eventually, sets up a new acceptable range for the error signal and/or adapts or corrects the process in the reference signal processor 6 to change or adapt the reference signal.

This means that the transfer function in the correction processor 7 is changed to an improved transfer function and thus also to an improved reference signal in the reference signal processor 6. This new reference signal now controls the digital signal processor 2 to adapt the output of the receiver 3 in such a way as to approach the signal in front of the eardrum as closely as possible and, of course, preferably in real time, to the desired sound signal in front of the eardrum.

It goes without saying that the operation between the units 5, 6 and 7 can be analog or digital, with the corresponding analog to digital and digital to analog converters in the corresponding locations.

Since the reference signal is developed or generated on the basis of the input signal to the digital signal processor 2 to represent a desired sound signal in front of the eardrum, there is a need to bring the transfer function comprising the output transducer, the earcanal in front of the eardrum and the sensing means into a corrected version of said transfer function.

After this detailed description of the circuitry and operation of FIG. 1 the following figures and their operation can be described in less detail, the more so as several processors are substantially the same and are designated with the same reference numerals.

Figure 2:
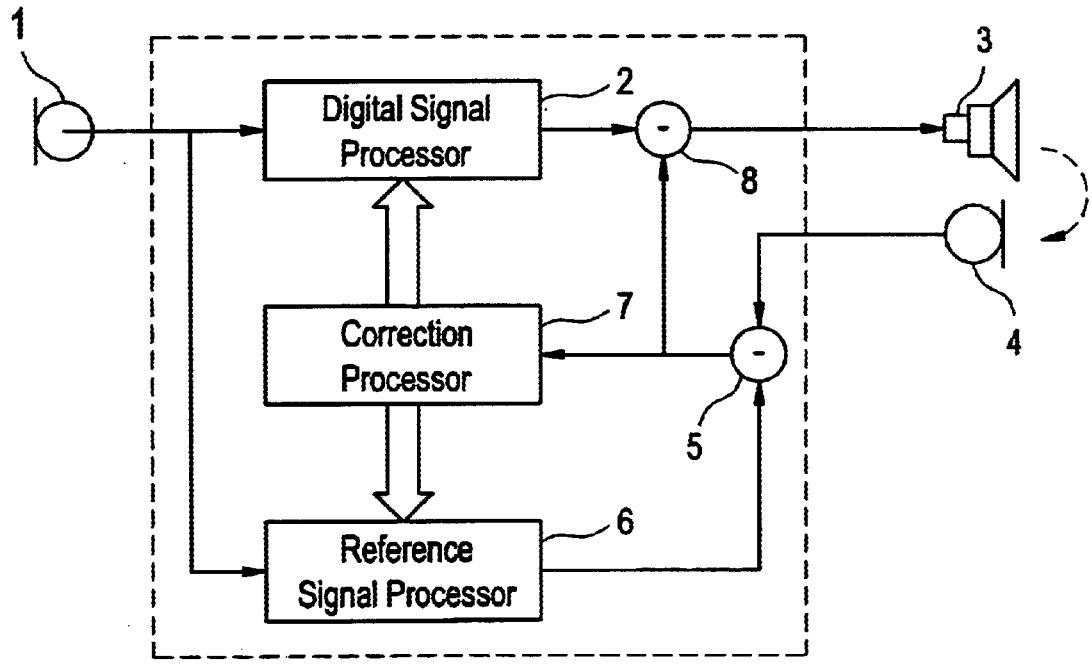
FIG. 2 shows schematically a second embodiment of such a hearing aid.
Figure 3:
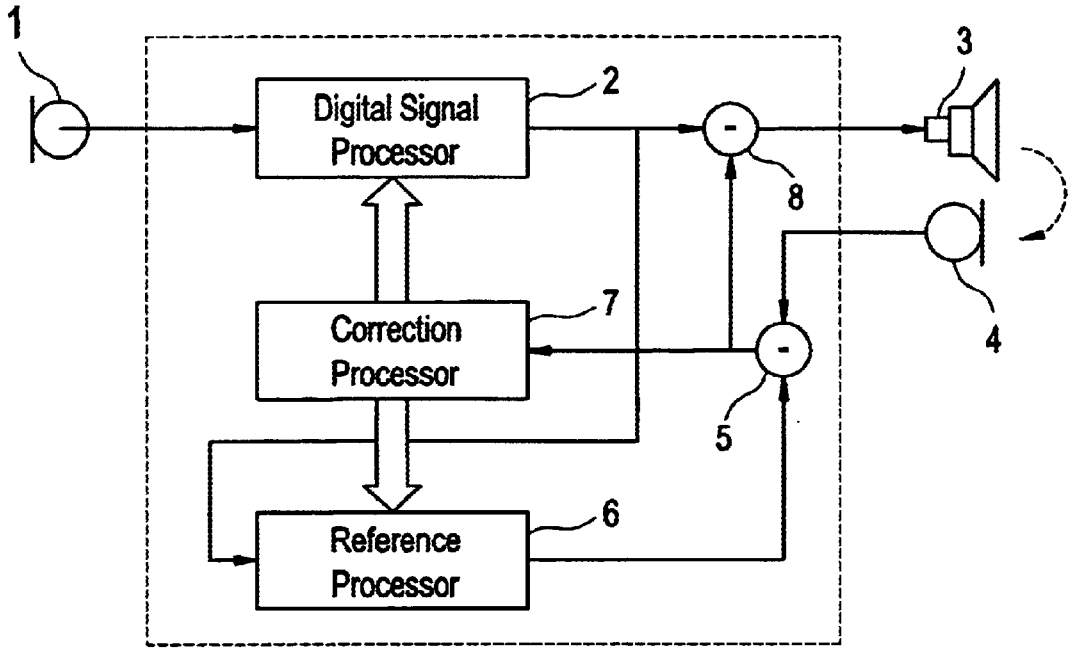
FIG. 3 shows a third embodiment of said hearing aid.
Figure 4:
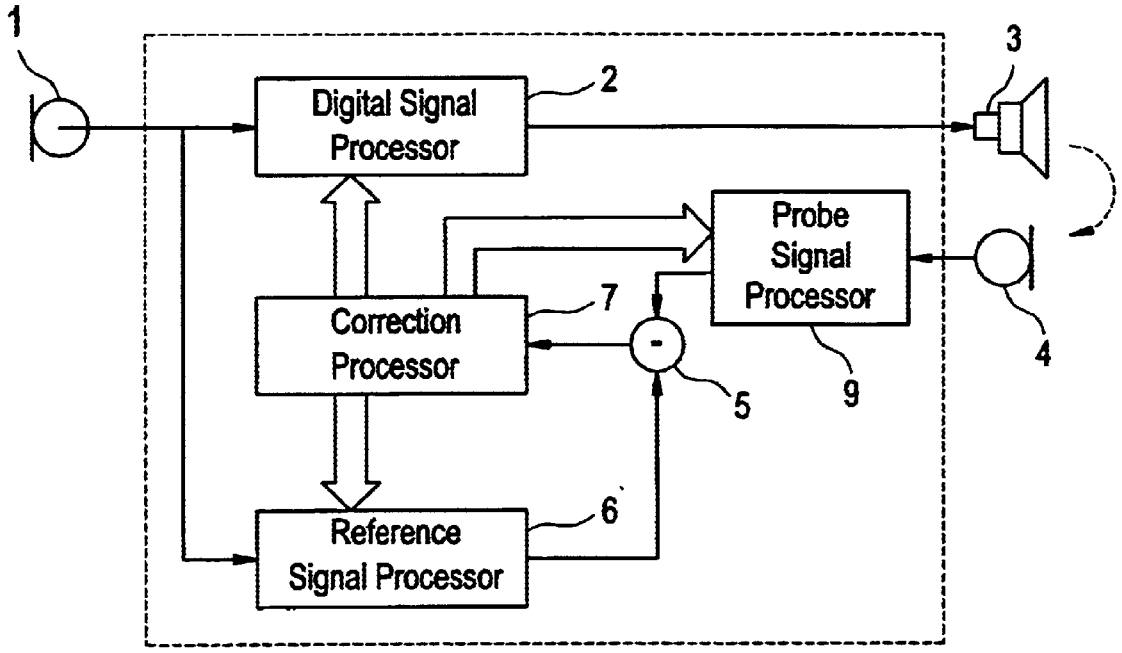
FIG. 4 shows another embodiment of said hearing aid.

All systems variations, i.e. single channel or multiple channel hearing aids which were already described with respect to FIG. 1 apply mutatis mutandis to FIGS. 2, 3 and 4 as well and need not to be repeated.

FIG. 2 shows a similar hearing aid for performing the inventive method, comprising an input transducer 1, a microphone, a digital processing system including f.i. at least one digital signal processor 2, an output transducer 3, a sensing means 4, a comparison means 5, a reference signal processor 6 and a correction processor means 7, which preferably is incorporated into the reference signal process of 6. In this embodiment the function in reference signal processor 6 is partly or totally the transfer function as the correction processor 7 operates with.

Additionally, a further modification means or correction means 8 between the output of the digital signal processor 2 and the output transducer 3 for further influencing the output signal of the output transducer 3 in real time is also connected to the comparison means 5 to control the input signal for the output transducer.

The possible material difference between the output signal of the sensing means and the output signal of the reference signal processor and the correction processor 7 in comparsion means 5 results again in an error signal which will also directly influence the output signal of the digital signal processor 2 and thus, the input signal to the output transducer 3. This will diminish or reduce the error signal almost immediately.

This may be of particular interest in case the error signal is the result of an erroneous transmission of an audio signal through the hearing aid into the sensing means, i.e. the probe microphone 4.

This error signal may also have been caused by other sources which may introduce a sound signal into the earcanal or the ear, f.i. occlusion effects, which could be overcome immediately.

The hearing aid shown in FIG. 3 is in many respect quite similar to the hearing aids shown in FIGS. 1 and 2 so that all generic remarks made in connection with those figs. apply also in FIG. 3.

However, the hearing aid shown in FIG. 3 differs in a material way from the previous figures.

The input signal for the reference signal processor 6 is now derived at the output of the digital signal processor 2 and not from its input side. Thus, the reference signal processor 6 does not have to emulate similar processing capabilities as provided in the digital signal processor and therefore can be less complex.

However, both systems have their advantages. The system in FIGS. 1 and 2 gives more time to process the signal in the reference signal processor 6 for generating the reference signal, whereas deriving the input signal for the reference signal processor 6 from the output of the digital signal processor 2 reduces the processing time in the reference signal processor.

Finally, FIG. 4 shows another embodiment of a hearing aid for performing the inventive process.

FIG. 4 shows an arrangement similar to the one shown in FIGS. 1 and 2, where the reference signal is derived at the input side of the digital signal processor 2 or even at the outputside of the microphone 1.

However, the sensing means, i.e. the probe microphone is now connected to a probe signal processor 9, which could include an analog to digital conversion means and even means for frequency characteristic correction and frequency band splitting, if so required. Such preprocessing for frequency characteristic correction can be of real advantage because it may then not be necessary to correct the individual probe microphone characteristics in the reference signal processor 6.

As can be seen from FIG. 4 the probe signal processor 9 may be controlled and adjusted from correction processor 7. The preprocessed probe microphone signal and the reference signal from the reference signal processor 6 are both applied to comparison means 5. In case there is a material difference between the two signals applied to comparison means 5, an error signal is developed to influence the correction processor 7 in the way as described in connection with FIGS. 1 and 2.

At the same time, the error signal developed at comparison means 5 influences via correction processing means the transfer function which results in an adjustment of the reference signal in the reference signal processor 6 and determines the transmission characteristic of the digital signal processor 2 and finally, of course, the input signal to the output transducer, i.e. the receiver 3 and thus the sound signal in the earcanal in front of the eardrum as closely as possible to the desired sound or sound pressure levels.

Furthermore, an analog to digital conversion and frequency band splitting in the probe signal processor 9 can be of great advantage for simultaneously correcting lower frequency components in the digital domain where time delay is of less importance than at higher frequencies.For this purpose the preprocessing of the incoming signal with a high-pass filter may be arranged to effect a 90 degree phase shift by a tone sequence, after a short time and thereby resulting in a virtual reduction of the time delay. At a frequency of 6000 Hz the virtual time reduction may be as much as 40 us. This preprocessing and correction may be performed digitally, or may eventually be performed in part or totally by means of an analog comparison means 5, and/or by an analog receiver 3, driven by an amplified error signal from the analog comparison means 5. The effect of the virtual reduction in time delay may advantageously be used to obtain extra time for the preprocessing of the probe signal, especially at higher frequencies, before a simultaneous correction by means of correction means 8 is performed in virtual real time for tone signals lasting for some time, which may happen for most high frequency tones generated or caused by occlusion effects.

Generally, it may be said that in FIG. 1 there is shown only one source of a reference signal, one reference signal processor 6, one comparison means 5 and, of course, one error signal developed from a comparison of the output signal of the sensing means and the reference signal from the reference signal processor 6 and in conjunction with the transfer function in correcting processor 7. There are, of course, possibilities to create multiple error signals as well.

In a preferred embodiment of the invention the correction processing means 7 or the reference signal processor 6 may contain a model of the electro-acoustic environment consisting of the ear and the hearing aid, to act, in this case, as a model processor. Such models are generally known as functions, which can be developed from various measurements of the system comprising the hearing aid in-situ and the ear.

Now, it is possible, in the same way as was described in connection with FIGS. 1–4, to update this model function in accordance with and in response to the error signals developed at comparison means 5. This could be done by using the model function which could f.i. be stored in a memory. However, it is to be preferred to use the model function to evaluate new parameter settings so that the system can adapt itself for various and changing situations and conditions, such as changing component values or characteristics, f.i. through aging, by changes in the residual volume in front of the eardrum, by leaks around the otoplastic in the earcanal etc.

The operation of the inventive process or method will now be explained in more detail in connection with some flow diagrams shown in FIGS. 5–8.

Figure 5A:
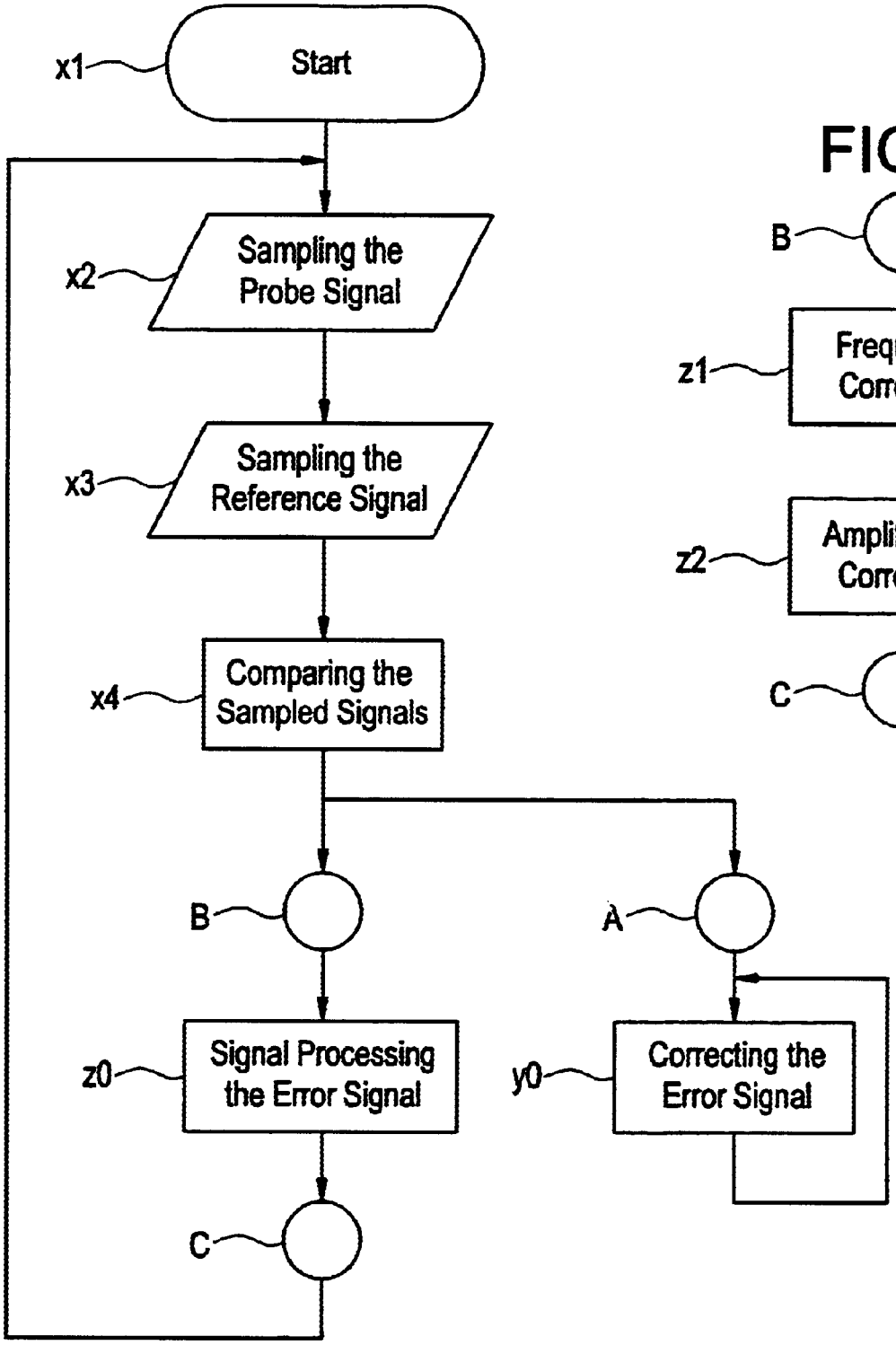
FIGS. 5*a* and 5*b* show alternative flow diagrams for the control of a hearing aid in accordance with the invention.
Figure 5B:
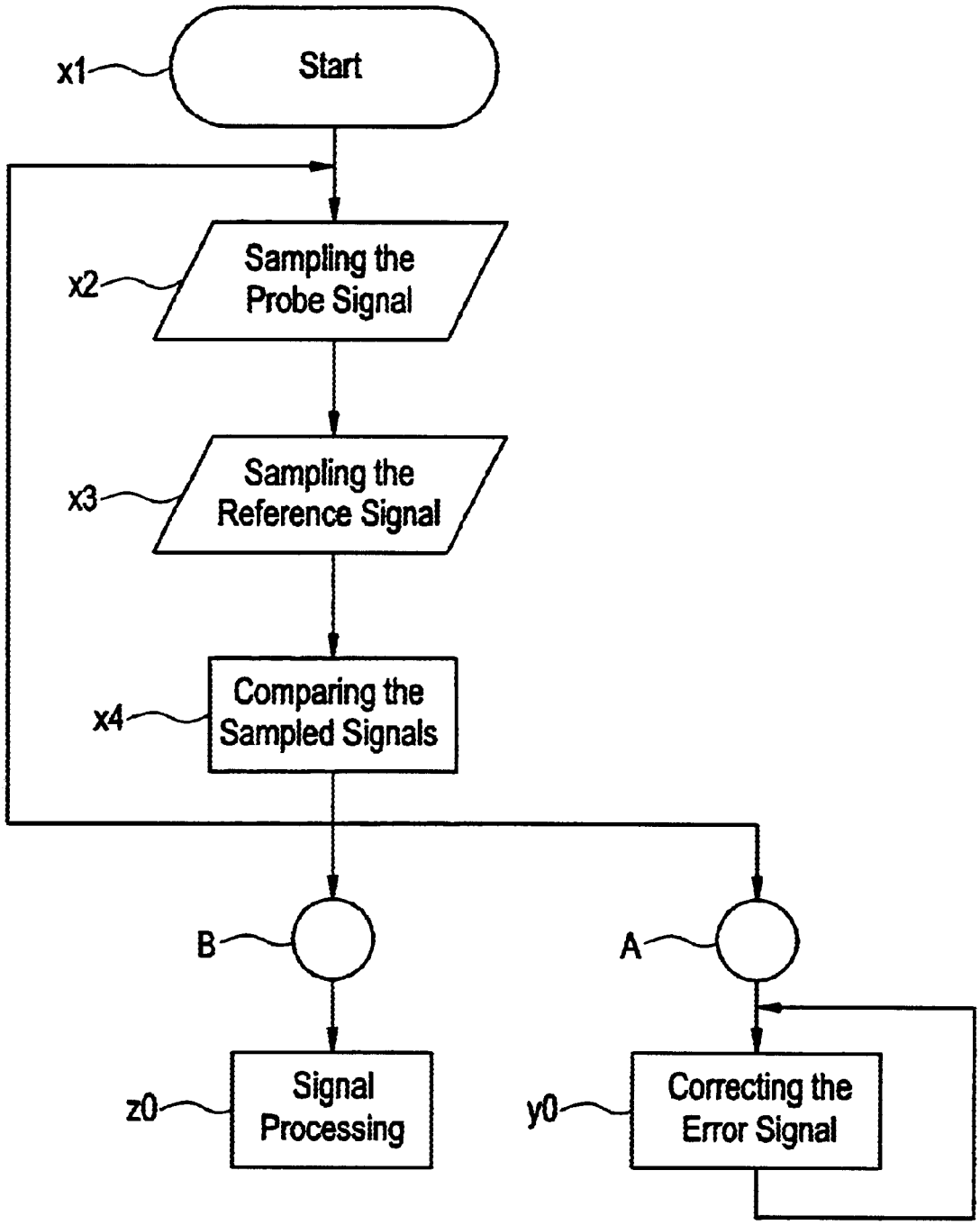

FIGS. 5*a* and 5*b*, schematically, show a flow diagram for the control of a hearing aid in accordance with the inventive method. It starts from block x1 where the method runs as a closed loop preferably synchronous with the generation of the reference signal and the probe signal, being applied to the comparison means 5. The comparison means 5 is realized with blocks x2, x3 and x4. In block x2 the probe signal is sampled and in block x3 the reference signal is sampled as well. In block x4 the sampled signals are compared and, in case there is a material difference between the two signals, an error signal or error signals are the result. The error signal is then applied to block A, in which the processes and values, based on the error signals are then corrected if necessary.

The error signal is also applied to B in which the output signal to the receiver 3 is corrected simultaneously.

The comparison in block x4 may be a simple subtraction or a more complex function which may employ a Fourier transformation of the sampled values, or sampling of multiple processed values from the reference signal processor 6 and the probe signal processor 9 after each sample, f.i. amplitude values after frequeny band splitting or Fourier transformation. Preferably, simple correction processes may be used to generate the error signal from comparison with the probe signal or signals for the simultaneous correction at high frequencies in order to save time and make the correction close to real time. Although the phase shift may be used to gain more time for complex processes, and make a virtual real time correction possible, as described earlier, it is preferred that most of the processes are performed on the reference signal. In order to generate the error signal for the correction process, complex functions may be used to generate the reference signal, because at least the same time is available for this process as for the processing of the audio signal from the point where the reference signal is derived.

Figure 6:
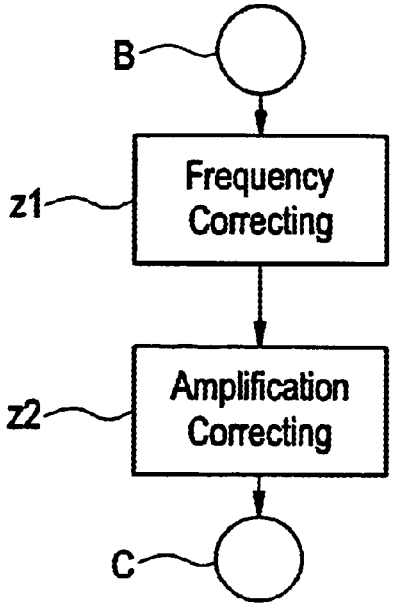
FIG. 6 illustrates processing in the block z0 in FIGS. 5*a* and 5*b*.

After the error signal has been generated for the simultaneous correction it is applied to the block z0, where the signal may be further processed before it is applied as the output signal of the hearing aid, as indicated in FIG. 6. The further processing in z1 and z2 may employ corrections as a function of frequency and amplification. The process from B to C is shown as a part of the loop in FIG. 5*a*, but it may be a synchronized or simultaneous process, which is not part of the loop, e.g. an anlog process which acts simultanously on the error signal, as shown in FIG. 5*b*.

Figure 7:
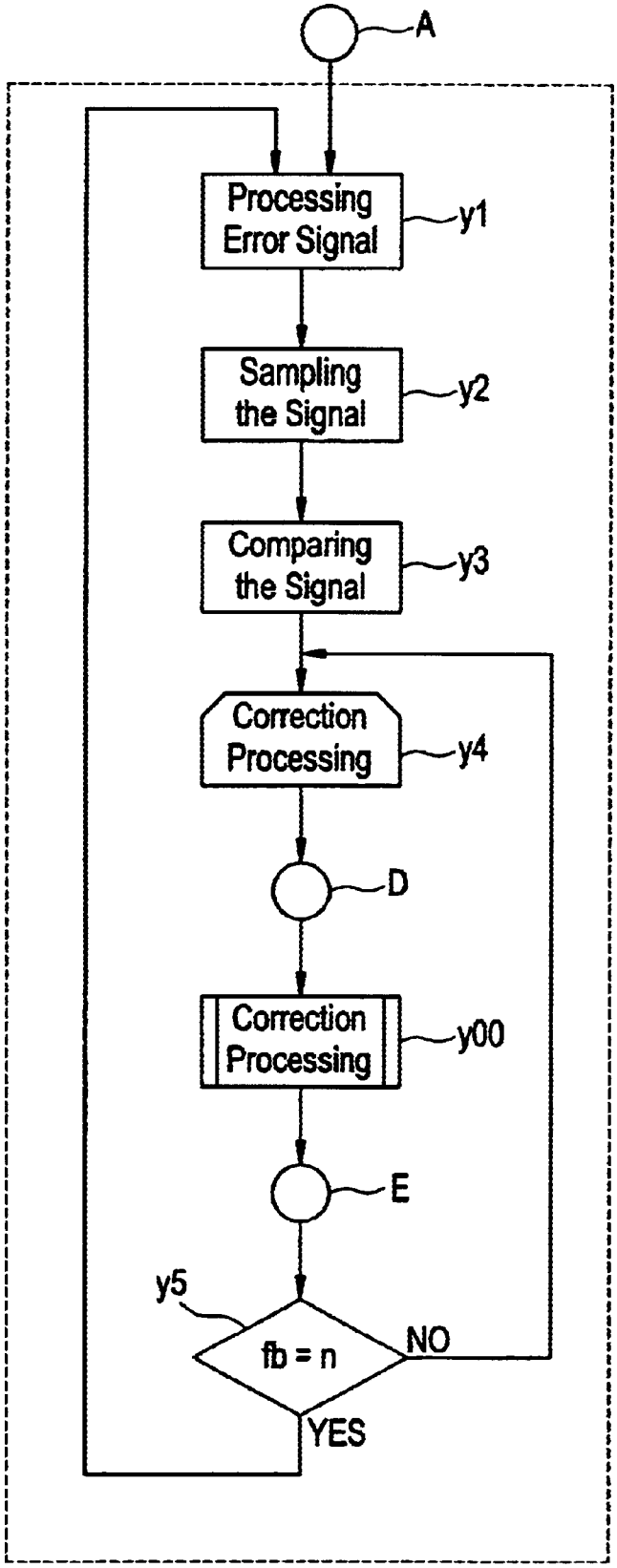
FIG. 7 illustrates schematically an example of the processing in block y0 of FIGS. 5*a* and 5*b*.

FIG. 7 shows schematically an example where the error signal, after its generation for the process correction is applied via point A to Block y1, in which the error signal is processed. This process can be Fast-Fourier-Transformation (FFT), if it has not been performed earlier. In the next block y2 the data from the audio signal process is sampled and further processed before it is compared in block y3 with the error signal from block y1. This comparison may determine whether or not the audio signal amplitude and/or error signal level is sufficient to cause a correction, and for which frequency bands the correction is to be activated.

This comparison may be relatively simple and may be performed on values obtained from a FFT.

After the comparison the result is applied to the actual correction process y4, D, y00 and E, where the process is corrected if necessary. This process is shown as a loop where block y4 and y5 ascertains that all frequency bands are tested in block y00 on basis of the comparison values from block y3. The block y4 may be for a "for next loop" running through all numbers n of frequency bands fb from fb=1 to fb=n. Block y5 can be an "if" function that returns the loop to y4 if fb is smaller and not equal to n(NO) and else(YES) brakes the loop and returns the process to the outer loop in y1 or to be started, if activated from point A.

Figure 8:
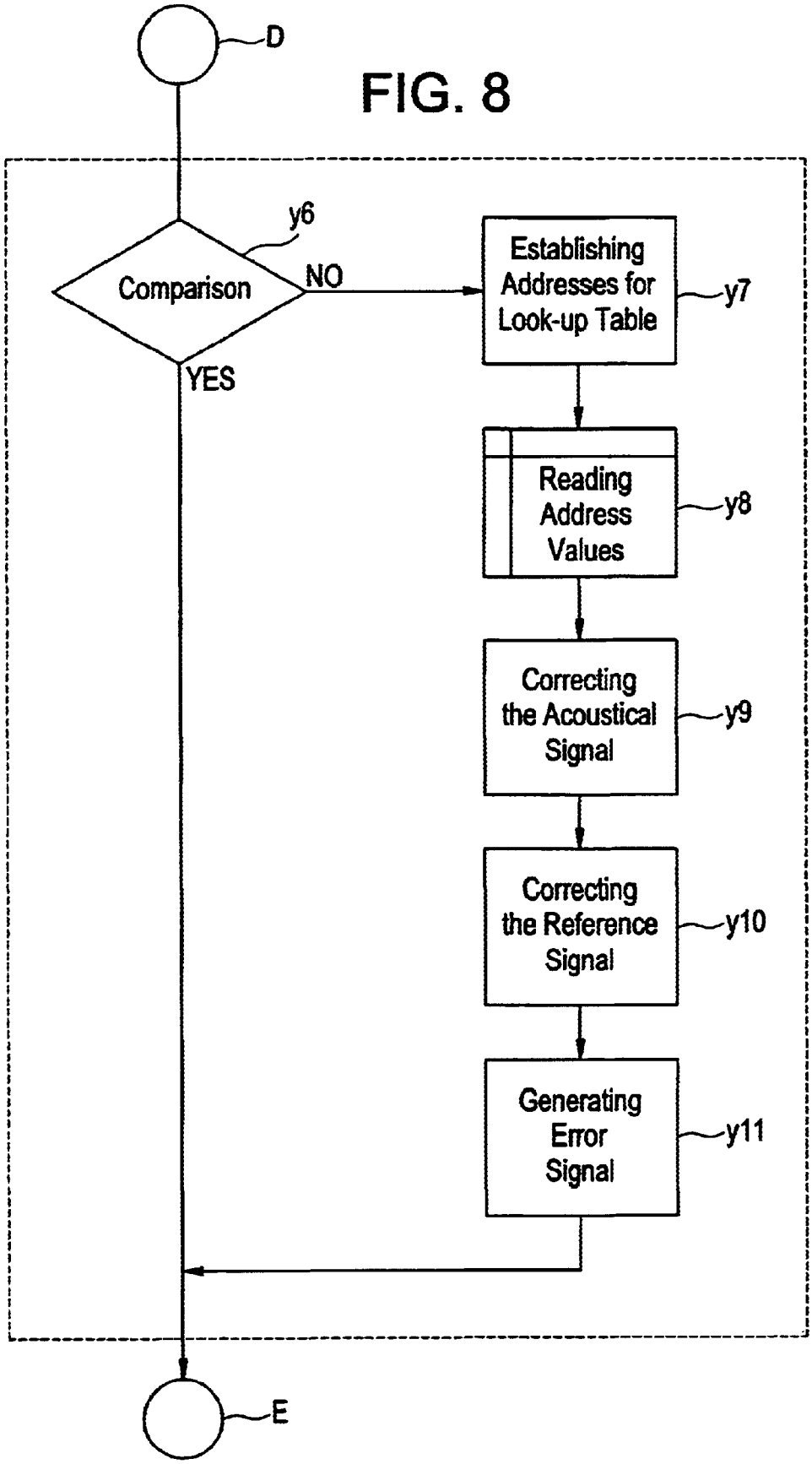
FIG. 8 illustrates schematically an example of the processing in block y00 in FIG. 7.

FIG. 8 shows schematically an example for a realisation of block y00, where the signal is applied to a comparison in block y6 via point D. There it will be determined whether or not the actual error level is within the range of the actual frequency band fb. If the level is within the range where nothing is to be done, the process is released at point E. If, however, the level is out of range and actions have to be taken, then the process passes to block y7 in which the output signal level and the error signal level are used to establish addresses for a lookup table. With these addresses values are read out from a lookup table y8. Thus, the acoustical signal process is corrected in block y9 with the correspondingly read out values and the reference signal process is corrected in block y10, the error signal range in block y11 and the process comes finally to an end at point E.

The address established in block y7 may be based on the actual values relating to the frequency band considered, or be a combination of values and values from other frequency bands together with the actual setting values. If the probe microphone 4 is placed within the housing of the receiver, the low frequency band may be used to determine leaks and volume changes and control the gain setting for the low frequency bands and the remaining bands. Furthermore, if the indicated and desired necessary changes are substantial changes of gain setting with respect to the actual settings, then the changes are to be made in intermediate steps to the desired changes. This may be done by intermediate addresses for the lookup table or by calculations in the correction processor 7.

The correction of the error signal range in block y11 may be omitted if the combined correction of the signal processors tries to minimize the error signal into a fixed value, e.g. zero. Otherwise, if different actual error signal range settings are used, it is preferred to process the error signals as fractional values, f.i.logarithmic or dB values, to make the error values relatively stable as compared with changes in the output level from the hearing aid. Furthermore, it is preferred to inactivate process corrections, if the output level from the hearing aid is not higher than the threshold values, to avoid correction of the processors due to weak sound levels which are not audible and contain no significant information regarding corrections.

Preferably, the simulation in the signal processing system establishes a complete model of the system which may then deduce the origins of changes, e.g. volume changes, leaks, occlusion effects, drifting component characteristics etc. and initiate corrections to establish a desired hearing sensation in front of the eardrum. The complete model may be formed as a combination of the correction process and the reference signal process in which the correction process contains the necessary value to correct the reference signal process and/or predict the error signal in order to act as a determined model or determined an actual model for the system without changing the reference signal process. The correction process may also contain the complete model and the reference signal process as a simplified process which only produces the same output result as the complete model.

In the above recited examples the corrections were made, based on empirical experience and calculated values stored in a lookup table but it is preferred that most of the values are calculated, based on a model.

What is claimed is:

1. Method to measure and correct or adjust the sound signal presented to the eardrum by means of a hearing aid in the operational position, including at least one microphone (1), at least one digital signal processing system comprising at least one digital signal processor (2) for transforming the incoming sound signal into a transformed signal in conformity with the desired transformation function, and at least one receiver (3) and a power supply, and having at least one sensing means (4) for sensing the signal appearing in front of the eardrum, said method using a reference signal representative of a desired sound signal in front of the eardrum, characterized by establishing a transfer function between the receiver (3) and the output of said at least one sensing means (4), generating a reference signal in a reference signal processor (6), said reference signal being based on an output signal of the at least one microphone (1) and being representative of a desired sound signal in front of the eardrum, correcting the process in said reference signal processor (6) in conformity with said transfer function, sensing the sound signal in front of the eardrum, and feeding said sensed signal back to an input of the signal processing system, comparing said sensed signal in a comparison means (5) with said reference signal, and in case there is a material difference between said sensed signal and said reference signal, correcting said transformed signal into a corrected transformes signal, for adjusting said signal in front of the eardrum to the desired sound signal.

2. Method according to claim 1, characterized by converting said sensed signal into a digital representation and performing said comparison and said correction digitally.

3. Method according to claim 1, characterized by using said material difference as an error signal to adaptively modify the process in said digital signal processor (2).

4. Method in accordance with claim 3, characterized by using said material difference from the comparison as an error signal to modify the process in a probe signal processor (9).

5. Method according to claim 1, characterized by using said material difference from said comparison as an error signal to adaptively modify the process in said reference signal processor (6) to create a minimized error signal.

6. Method according to claim 1 characterized by using said material difference from said comparison as an error signal to adaptively modify the process in said reference signal processor (6) and said digital signal processor (2) to minimize said error signal.

7. Method according to claim 1, characterized by using said material difference from said comparison as an error signal to modify the transformed signal of said digital processor (2) by modification means (8).

8. Method according to claim 1, characterized by using said material difference from said comparison as an error signal for a correction processor (7) to modify the process in said digital signal processor (2).

9. Method according to claim 8, characterized by using said material difference as an error signal for said correction processor (7) to modify the process in said digital signal processor (2) and said reference signal processor (6).

10. Method according to claim 1, characterized by using said material difference as an error signal for a correction processor (7) to modify the process in said reference signal processor (6).

11. Method according to claim 1, characterized by using said material difference from said comparison or said output signal from said sensing means (4) as an input signal to a process which includes an electroacoustic model consisting of the ear and said hearing aid, to adaptively modify at least one of the processes in said reference signal processor (6) and said digital signal processor (2) on the basis of one or more values resulting from the process in said electroacoustic model.

12. Method in accordance with claim 1, characterized by using at least one of said comparison means (5), said reference signal processor (6) and said correction processor (7) as parts in the electroacoustic model.

13. Method according to claim 1, characterized by using a probe microphone as said at least one sensing means (4).

14. Method according to claim 1, characterized by using said receiver (3) as said at least one sensing means (4).

15. Hearing aid including means to measure and correct or adjust the sound signal presented to the eardrurn, said hearing aid including at least one microphone (1), at least one digital signal processing system including at least one digital signal processor (2) transforming the incoming sound signal into a transformed signal in conformity with a desired transformation function, with at least one receiver (3) and a power supply, said signal processing system further including a reference signal means using information representative of a desired sound signal in front of the eardrum, said hearing aid including at least one sensing means (4) for sensing said signal appearing in front of the eardrum, characterized in that said signal processing system includes processing means adapted to hold a representation of the transfer function existing between said receiver (3) and the output of said at least one sensing means (4), said processing means containing a reference signal processor (6) for generating a reference signal, directly or indirectly based on an output signal of said at least one microphone (1), said reference signal being representative of a desired sound signal in front of the eardrum, said signal processing system further containing comparison means (5) for receiving at least one corrected reference signal from said reference signal processor (6) and at least one output signal from said sensing means (4), for generating at least one error signal, said digital signal processing system also comprising modification means (7; 8) for effecting in response to said at least one error signal a modification of the output signal of said digital signal processor (2) into a corrected transformed signal, in case there is a material difference between said sensed signal and said corrected reference signal.

16. Hearing aid in accordance with claim 15, characterized in that said modification means (8) in said signal processing system is arranged to receive said at least one error signal from said comparison means (5) to modify said transformed signal.

17. Hearing aid according to claim 15 characterized in that the modification means (7, 8) In said signal processing system contains a correction processor (7) that is arranged to receive said at least one error signal from said comparison means (5) to adaptively modify the process in said digital signal processor (2).

18. Hearing aid according to claim 17, characterized in that said correction processor (7) as one of the modification means (7; B) in said signal processing system is arranged to receive said at least one error signal from said comparison means (5) to adaptively modify the process in said digital signal processor (2) and said reference signal processor (6).

19. Hearing aid according to claim 15, characterized in that the modification means (7, 8) in said signal processing system contains a correction processor (7) that is arranged to receive said at least one error signal from said comparison means (5) to adaptively modify the process in said reference signal processor (6).

* * * * *